United States Patent [19]

Litwak

[11] Patent Number: 4,947,943

[45] Date of Patent: Aug. 14, 1990

[54] FISHERMAN'S GEAR-STORING ICE AUGER

[76] Inventor: John Litwak, 428 Dock St., P.O. box 0607, Schuylkill Haven, Pa. 17972-0607

[21] Appl. No.: 307,319

[22] Filed: Feb. 6, 1989

[51] Int. Cl.[5] ..... E21B 10/44

[52] U.S. Cl. ..... 175/18

[58] Field of Search ..... 175/18; 299/24; 81/490; 408/241 R

[56] References Cited

U.S. PATENT DOCUMENTS

| | | | |
|---|---|---|---|
| 3,168,923 | 2/1965 | Lind | 175/18 |
| 3,929,196 | 12/1975 | Rantanen | 175/18 |
| 4,539,750 | 10/1985 | Jaivi et al. | 175/18 X |

FOREIGN PATENT DOCUMENTS

| | | | |
|---|---|---|---|
| 140496 | 3/1953 | Sweden | 175/18 |

*Primary Examiner*—William P. Neuder

*Attorney, Agent, or Firm*—Steele, Gould & Fried

[57] ABSTRACT

A fisherman's ice auger has a hollow tubular body with an open end and a closed end, and a support pivotably retaining a crank handle in either of a deployed position, for cranking the body about its axis, and a stowed position wherein the crank handle is pivoted back along the body for gripping and transporting the ice auger. Helical webs on an outside of the tubular body, extending helically away from the open end. Preferably-replaceable cutters are mounted at the ends of the helical webs. A removable cap overfits the open end of the body, closing off the inside of the tubular body and defining a receptacle for carrying ice fishing articles, and also protecting the cutters. The cutters have a disc-shaped or spade-shaped blade attached to the leading edge of a shoe mounted on the open end of the tubular body.

4 Claims, 2 Drawing Sheets

Fig. 6.
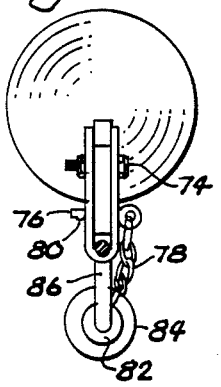
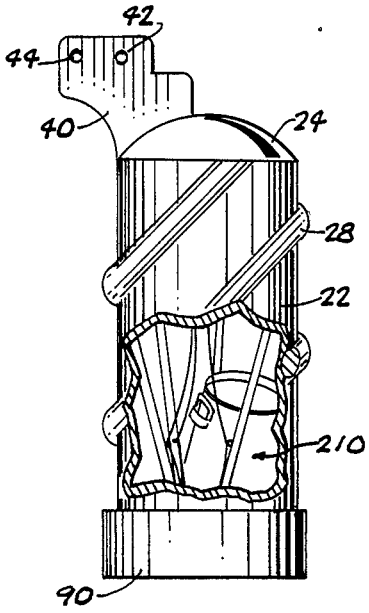
Fig. 7.
Fig. 8.
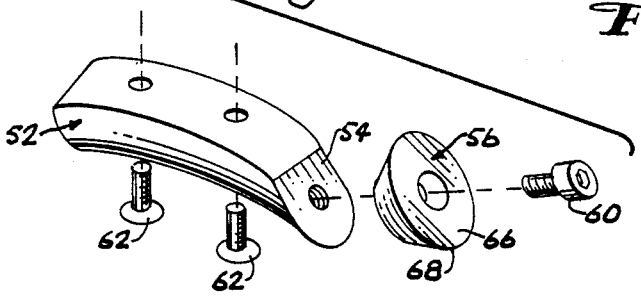
Fig. 9.
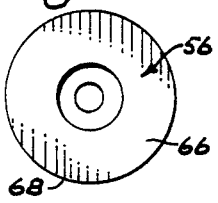
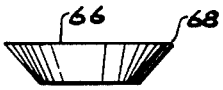
Fig. 10.
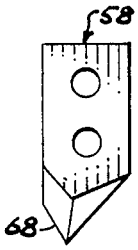
Fig. 11.
Fig. 12.
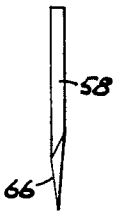
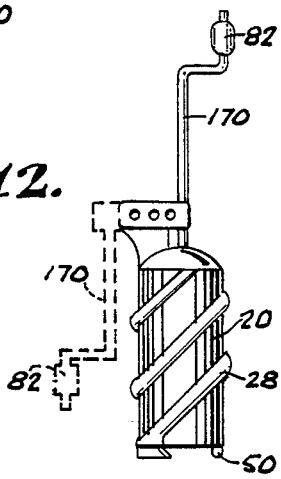
Fig. 13.

FISHERMAN'S GEAR-STORING ICE AUGER

BACKGROUND OF THE INVENTION

1. Field of the Invention

This invention relates to an auger for cutting a fishing hole through ice, which also serves as a carrying case for ice fishing apparatus such as lines, poles, bait and the like.

2. Description of the Prior Art

The sport of ice fishing presents many challenges to the fisherman. Among these is the drilling of suitable holes in the ice through which the fisherman can extend his or her lines. Historically, ice fishing holes were chopped through the ice using an axe, pole, shovel or similar general purpose tool. There are also, however, several known ice augers available to the ice fisherman, which are much more convenient to use than chopping holes and produce a neat round hole with minimal effort. The ice auger can have a helical web wound around a solid shaft, resembling a woodworking drill bit, the web carrying away the ice shaved from the hole by at least one radial cutting bit. This type of tool requires the user to expend some unnecessary effort because the ice must be cut clear across the hole to be opened, using a cutting edge extending at least across the full radius of the hole. The hole is also left with slush and/or ice chips floating on the surface.

Tubular shaped ice augers are disclosed in U.S. Pat. Nos. 2,955,805-Jones and 1,857,585-Brooks. In each of these coring-type augers, cutting means are disposed only at the end of a tube whose outer surface is encircled by a helical screw web for carrying ice chips away from the hole. In use, the tube is arranged perpendicular to the plane of the ice and is rotated, thereby shaving away an annulus of ice and freeing a solid cylindrical plug or core. Brooks provides for temporarily engaging and lifting the severed core of ice from the hole, by closing an air passageway above the core and through the tube.

An ice fisherman may need to travel some distance and to carry a variety of items as needed for fishing, for consumption while fishing, and to keep warm. Unlike warm weather fishing, a plurality of holes and lines are typically maintained while ice fishing, often by means of fish-triggered line tending devices, for example the popular "Tip-Up" devices, which are placed at each hole. Ice augers are convenient for hole cutting, but can be bulky and awkward to carry onto the ice, particularly together with a number of Tip-Ups, a lunch, bait, extra clothing, etc.

To overcome problems with too much to carry, a compact or even collapsible ice drilling tool may be considered desirable. U.S. Pat. No. 3,647,008-Isaksson discloses a collapsible bit and brace type ice drilling tool. The crank handle portion folds back and thereby allows the user to carry the entire tool by the same handle which is turned while drilling. The bit is of the twist-drill type, with a solid shaft and helical web wound thereon. The central shaft of the bit or auger portion is pivotable at a knuckle having an axis disposed at an angle relative to the plane of the handle, which is U-shaped in the manner of a bit-and-brace handle. However, even with a collapsible drill, there is still a need to reduce or somehow accommodate the considerable amount of apparatus to be carried out onto the frozen lake or stream. Heretofore there has been no ice cutting apparatus which addresses the larger problem of transporting the necessary materials for ice fishing. Of course there is likewise no device for maximizing the efficiency of a device for ice cutting which also defines a carrying case for the apparatus used in ice fishing.

SUMMARY OF THE INVENTION

It is an object of the invention to provide an inexpensive and durable device for cutting out a core of ice, which also is adapted for carrying equipment used in ice fishing.

It is another object of the invention to provide a tubular ice coring tool which can conveniently be molded from inexpensive resin materials and which carries very durable replaceable cutting bits.

These and other objects are achieved by a fisherman's ice auger having a hollow tubular body with one open end and one closed end, the closed end including a support pivotably retaining a crank handle such that the crank handle can be set in a first position for cranking the tubular body about its axis, the crank handle and the body being elongated in said first position, and a second position wherein the crank handle is pivoted back along the body for stowing the crank handle and providing means for gripping the ice auger for transport.

The ice auger has a plurality of helical screw webs on an outside of the tubular body, each of the webs extending helically away from the open end. A plurality of preferably-replaceable cutters are mounted at the ends of the helical webs at the open end of the body. The handle can be locked in either the elongated or stowed positions by means of at least one pin engageable with the handle and a standing flange at the closed end of the tubular body. A removable cap overfits the open end of the body, closing off the inside of the tubular body for safely carrying various articles, and also protecting the cutters. Each cutter preferably includes a disc-shaped blade attached at an incline to a shoe, the shoe being attachable to the open end of the tubular body.

The fisherman's ice auger of this invention is an efficient ice cutter that quickly removes an annulus of ice when deployed, and doubles as a carrying case for holding ice fishing equipment, namely poles, reels, bait, line monitoring devices, etc. The device has a large diameter tubular body, preferably molded of a reinforced fiberglass and resin composition and substantially or completely closed at one tube end. On the outside of the tube, a plurality of helical screw webs integral with the tube lead to the open end of the tube, where replaceable steel cutters are mounted on durable metal shoe supports. Three evenly spaced helical screw webs are preferably provided, thereby placing the cutters 120 degrees from each other on the open end of the tube. It is also preferable that the webs be wound on the body at a 45 degree angle for lifting the ice chips. The shoes for the cutters are attached to enlargements at the ends of the helical webs on the open end of the tube and are fastened by screws that thread into inserts located on the tubular body. The diameter of the rotary cutters (preferably $\frac{3}{4}''$ to 1" in diameter) provides clearance for the outside tube diameter and inside clearance for the ice core, cutting an annulus having a width equal to the diameter of the cutter. The cutter diameter and its angle with respect to the shoe control the cutting rate and necessary torque. It is preferred to have an angle of about 1° to 10° between the shoe and the leading edge of the cutter. A removable cap is provided to cover the cutters and open end of the tube when the tube is being used as a carrying case for ice fishing equipment.

The closed end of the tubular body has a fitting for pivotably receiving and/or locking the end of a crank handle. The crank handle doubles as a carrying handle for the overall apparatus, the handle being similar to a bit-and-brace handle, with a U-shaped bend. When in the drill position, the handle is locked in place on the body to extends upwardly from the closed end. To be used in the carry position, the handle is rotated toward the tubular body and held in position in line with the tube.

BRIEF DESCRIPTION OF THE DRAWINGS

There are shown in the drawings the embodiments that are presently preferred. Additional embodiments of the invention will be readily ascertainable to one skilled in the art from a consideration of the following figures, description and exemplary embodiments. The drawings are illustrative only and that changes may be made in the specific construction illustrated and described, and the invention may be capable of other arrangements and groupings of elements, within the scope of the appended claims.

FIG. 6 is an elevation view from the right in FIG. 2.

FIG. 7 is a partial cut-away elevation view showing articles carried in the apparatus.

FIG. 8 is an exploded perspective view of the cutter mounting shoe of the apparatus.

FIG. 9 is a front elevation view of a form of cutter blade for use in the invention.

FIG. 10 is a side view of the cutter as shown in FIG. 9.

FIG. 11 is a front elevation of an alternative form of cutter.

FIG. 12 is a side view of the cutter as shown if FIG. 11.

FIG. 13 is an elevation view of an embodiment of the invention with a different form of crank handle.

DETAILED DESCRIPTION OF THE PREFERRED EMBODIMENT

Figure 1:
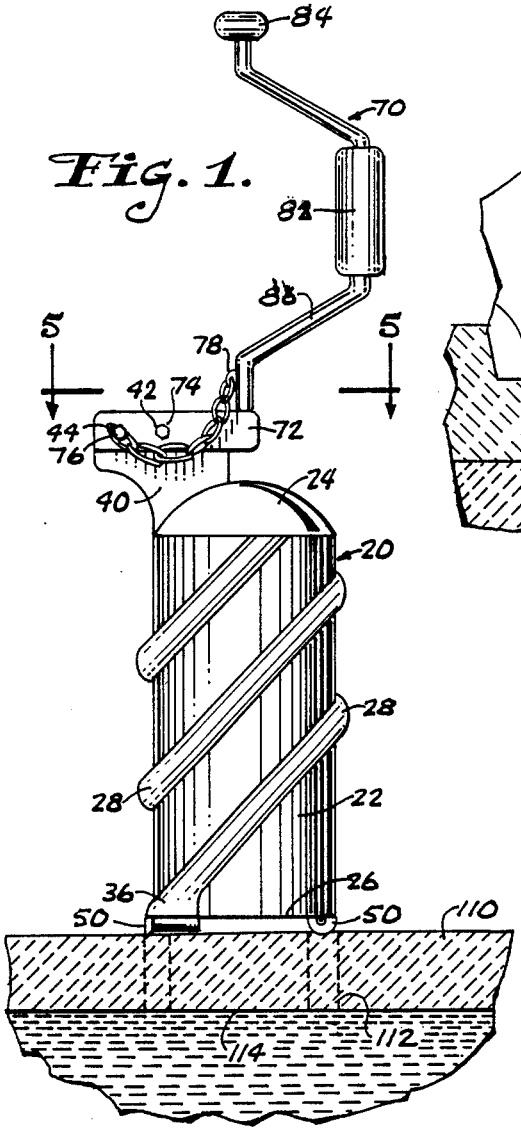
FIG. 1 is an elevation view of the invention, shown in cutting position over a layer of ice, the ice shown in section.
Figure 4:
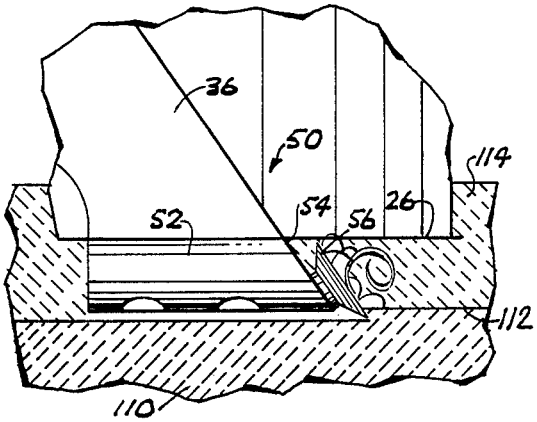
FIG. 4 is a detailed elevation view of the apparatus in the area of the cutters engaging the ice.

FIG. 1 shows the ice auger according to the invention in its deployed, operative position. The auger has a body portion 20 and handle 70, the handle 70 being oriented generally along the longitudinal axis of tube 22, which substantially defines body 20. Tube 22 is hollow and has a closed end 24 and an open end 26. In use, the tube is placed generally perpendicular to the plane of ice 110, and is rotated such that an annulus 112 of the ice 110 is removed, freeing a central core 114, allowing access to the water below the ice sheet.

Figure 3:
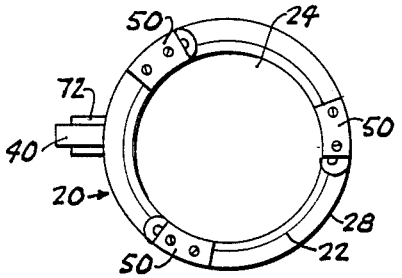
FIG. 3 is a bottom plan view of the apparatus of the invention as shown in FIG. 1.
Figure 5:
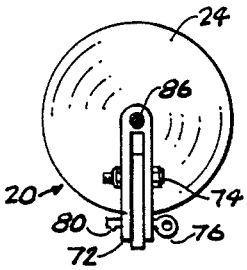
FIG. 5 is a section view taken along line 5—5 in FIG. 1.

At least one cutter 50, and preferably a plurality of equally-spaced cutters 50, are arranged at the open end 26 of tube 22 such that cutters 50 protrude axially and engage the ice 110. As cutting proceeds through the ice, at least one or more preferably a plurality of helical fins 28 can be used to carry the chipped ice upwardly from the annulus 112. The helical fins 28 are preferably arranged such that the lower terminus of each fin 28 is aligned with a cutter 50. As shown in FIG. 3, the cutters 50 are substantially as wide in a radial direction as the width of tube 28 such that the cutter 50 opens a space for body 20 as cutting proceeds.

Cutting is manually accomplished in the manner of a bit and brace. At least one grip 82, and preferably two grips 82, 84, are arranged on a shaft 86 such that at least one of the grips is eccentric with respect to the longitudinal axis of tube 22. The grips 82, 84, or the single grip 82 and the shaft 86, are rotated around the longitudinal axis of tube 22 to effect cutting.

Figure 2:
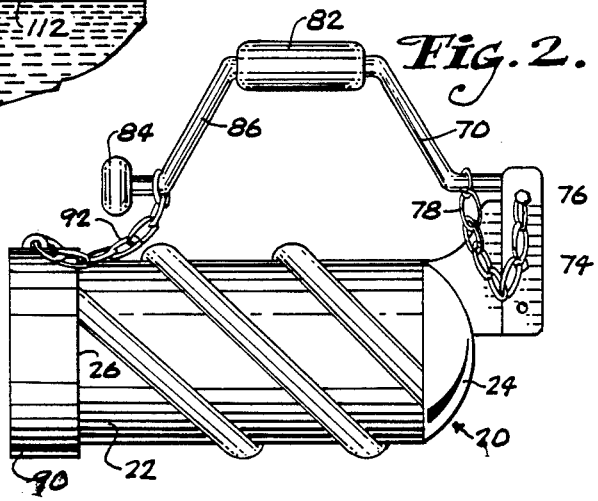
FIG. 2 is an elevation view of the invention, shown in its handle-stowed, article carrying configuration.

According to the invention, the handle 70 can be placed in a stowed position, illustrated in FIG. 2, whereupon hollow tube 22 becomes a conveient receptacle for carrying ice fishing items. Handle 70 is placed in the stowed position by rotating the handle downwardly around a pivot adjacent the upper, closed end 24 of body 20. Grips 82, 84 thereby become convient carrying means.

Handle 70 is preferably attached to body 20 by means of a standing flange 40, rigidly or integrally attached to body 20 at closed end 24. As shown in FIGS. 1–3, handle 70 has a strap portion 72, to which the proximal end of handle 70 is attached, preferably by welding. Strap 72 is substantially U-shaped, and has three holes adapted to align with two corresponding holes in standing flange 40, whereby handle 70 may be locked in either the extending, deployed condition (FIG. 1) or the folded-down stowed position (FIG. 2). Standing flange 40 is shown most clearly in FIG. 7. A pivot hole 42 is defined in flange 40, as is a locking hole 44. A pivot bolt 74, shown in FIGS. 1, 2, 5 and 6, retains handle 70 on flange 40 via strap 72. Bolt 74 may be a bolt with a captive nut, a large rivet, or other means defining a pivot axis for the handle. Pivot bolt 74 bears a load when handle 70 is used for carrying the device, however, in the ice-boring operative position, the torque exerted on handle 70 is substantially borne by strap 72 and flange 40, rather than bolt 74.

In order to rotate handle 70 into the stowed position, the user removes a locking pin 76, rotates the handle into the position shown in FIG. 2, and re-inserts locking pin 76 in the locking hole 44, this time through the third hole in strap 72, which aligns with locking hole 44 when the handle is stowed. Accordingly, the handle 70 is lockable either in the extended or stowed position by mean of pin 76 and locking hole 44. Preferably, pin 76 is a simple detent pin, tethered to handle 70 by means of pin tether chain or string 78. The detent pin, as known in the art, can be a pin having a movable projection spring biased to protrude radially. When pin 76 is pushed through hole 44 until its head approaches strap 72, the spring biased projection protrudes radially from the pin on the far side of flange 40 and strap 72, thereby keeping the locking pin in place.

It is possible according to the invention to carry the device as shown in FIG. 2 by grasping handle 70 at a point closer to open end 26 than the center of gravity of the device, preferably as loaded with fishing equipment 210. Accordingly, the tube 22 tends to tip such that the open end is up, whereupon the device is useful for carrying fishing implements 210. Preferably, however, a removable end cap 90 is provided to enclose the open end of tube 22, confining articles 210 and also protecting cutters 50 as well as various items with which cutters 50 may come into contact. Cap 90, preferably a flexible plastic cap having tether 92 attached to handle 84, fits tightly over the open end 26 of tube 22, being dimensioned to encompass tube 22 and cutters 50.

Cap 90 can be arranged such that its edge directed toward the closed end 24 of tube 22 is slightly smaller than the outside diameter defined by cutters 50 or helical fins 28. Therefore, cover 90 is stretched over these parts and remains tightly in place. Tether 92 ensures that cap 90 is not easily lost.

Body portion 20 can be formed by attaching to a length of pipe helical fins 28, cutters 50, a closing end 24 and flange 40. It is preferable, however, to mold body 50 as a unit. A resin transfer method is appropriate, and may be accomplished in two steps, a first to mold the pipe and closed end, and a second to mold and attach the helical fins and flange. A resin and fiberglass molding procedure is recommended, resulting in a strong and durable body 20. The resin transfer method involves preparing a female mold, lining the mold with a fiberglass cloth, and impregnating the cloth with resin, usually by applying a vacuum to the mold. It is also possible to mold the device using a compression-type mold with male and female members engaged around a resin which is compressed between the mold parts. As a further possibility, the body 20 can be formed by parison molding.

Body 20 is preferably about 30–32 inches (approx. 0.8 m) in length, which size has been found convenient for use in cutting the ice and also convenient for carrying typical ice-fishing apparatus, including Tip-Up line tending devices and the like. The preferred inside diameter of the tube is 6 inches (15 cm), and the width of the tube and helical fins is about one-half inch (1.2 cm), whereby the preferred device forms a hole 7 inches (18 cm) in diameter. It will be appreciated that other dimensions can likewise be used.

The handle is preferably formed from half inch diameter steel rod, welded to a strap in the form of 3/16 inch steel strap, for example one inch wide. The strap is wrapped around the end of handle 70 and welded. Preferably, stops are also welded to the handle, in order to retain grips 82, 84 in position. Grips 82, 84 may be molded plastic tubes formed in diametrically facing parts. Protrusions (not shown) on handle 70 engage in internal grooves in grips 82, 84 to keep them in place. The grips can also be captive between protrusions of handle 70 formed outside the grips, or other means as known in the art.

Some preferred embodiments for cutter blades and mountings are shown in FIGS. 8–12. The cutters 50 are each preferably provided with a shoe portion 52, with an inclined leading face 54, to which a blade 56, 58 is attached. The leading face 66 of the blade is inclined, preferably at an angle to match the angle of helices 28. The cutting edge 68 of the blade protrudes slightly below the bottom of shoe 52, such that the cutter will dig into the ice at an angle defined by a line between the cutting edge and a lower surface of shoe 52.

Shoe 52 is mounted to an enlarged terminus 36 at the bottom of a helix 28. Preferably, three cutters 50 are provided, each at the lower terminus of a 45° helical fin 28. Shoe 52 is as wide as the thickness of the fin and tube together, such that the cutter opens precisely the required space, as shown in FIG. 3. Shoe 52 may be attached to the widened terminus of fin 28 by means of fasteners 62, extending into the widened terminus or foot 36. For this purpose, countersunk holes are formed through shoe 52, fasteners 62 preferably being engagable with complementary fasteners embedded in foot 36. Blade 56 or 58 is attached to the inclined leading edge 54 of shoe 52 by means of a screw 60. Preferably, screw 60 is a flathead screw which rests flush in blade 56 or 58, by means of a countersunk hole as shown in FIG. 9.

The cutter blade can be a more durable tool steel, for example a mild (e.g., hot-rolled) steel with case hardening. It is preferred that the relief angle of the cutter blade (the effective angle) be between 1° and 10° relative to horizontal. In this manner, the user typically can cut through 6 to 12 inches of ice using only 50 to 150 strokes and moderate pressure. The helical lift angle is preferably 45°, to prevent packing of ice or undue resistance to rotation.

An alternative cutter design is shown in FIGS. 11 and 12. In this embodiment, the cutter is an asymmetrical spade-shape, terminating in a point. Blade 58 is mounted in a manner similar to blade 56, but may have a pair of fasteners or other means to retain the correct alignment of the blade 58 relative to the shoe 52. The flat face 66 of blade 58 leads in the cutting direction. Preferably, the asymmetrical blade 58 is placed such that the terminal point is radially further out from the access of tube 22 than the center line of blade 58.

An optional handle arrangement is shown in FIG. 13. In this embodiment, grip 82 of handle 170 is eccentric with respect to the longitudinal axis. An additional grip (not shown) can be provided along shaft 170, if desired. Alternatively, the grips may be omitted all together. Like the previously-described embodiments, handle 170 is pivoted between its deployed condition, shown in FIG. 13 in solid lines, and its stowed position shown in broken lines. The eccentric grip portion 82 in FIG. 13, is in the stowed position close to the open end of body 20, thereby being below the center of gravity of the device. Accordingly, the cap 90 (see FIG. 7) need only be loosely fitted.

The metal parts including shoe 52 and handle 70, 170 are preferably coated by a powder epoxy coating technique. The shoes 52 are replaceable by removing fasteners 62, which are simply threaded upwardly into foot 36 through countersunk holes in the bottom of shoe 52. The shoes can be color coded for particular blade angles, whereby the user can select an appropriate cutting angle. Lower cutting angles render the device easier to turn, but it takes longer to progress through a given thickness of ice. The device can also drill through other materials.

It is possible to arrange a hole in the closed end 24 for passage of air, such that the removed core 114 will fall out of the tube and not become frozen therein. Should the user so desire, the hole in the tube can be closed with a finger to lift the core 114 out of the plane of the ice, whereupon the hole is uncovered and the core is released. Preferably, the core 114 is simply pushed downwardly under the edge of ice 110, and does not become a dangerous obstacle on the surface of the ice.

Body 20 is preferably colored a bright color, being easy to see on ice and snow. It is preferable that the body not absorb a great deal of heat radiation, however, such that it will not become lost by melting into a snowbank.

The handle 70, 170 can be arranged in various different configurations, provided there is at least one element eccentric to the axis of tube 22, allowing the user to exert a torque as needed for drilling. In addition to the possibilities shown, a circular disk can be placed at the end of the handle, dimensioned to cover the open end of tube 22 and rotate it downwardly, and provided with an eccentric grip.

Other variations will now be apparant to persons skilled in the art. The device, for example, can be provided with a greater number of helical fins, cutters or the like. A left handed version can be provided, with the helices proceeding in the opposite direction. Other specific structural configurations and manufacturing methods are within the scope of the invention as disclosed and claimed.

The invention may be considered an ice auger, comprising a hollow tubular body 20 defining an axis, the body 20 being open on one end 26 and substantially closed on an opposite end 24. A handle 70, 170 has a shaft part 86 and a grip part 82, 84, the handle 70, 170 being attachable to the body 20 at a first position relative to the body (FIG. 1), in said first position the handle 70, 170 extending generally along the axis away from the body 20, and one of the shaft part 86 and the grip 82, 84 being eccentric to the axis, whereby the handle 70, 170 is operable manually to turn the body 20 around the axis. Means 40, 42, 44 are provided on the body 24 attaching the handle 70, 170 at a second position (FIG. 2), wherein the handle is disposed along an outside surface of the body 20, generally parallel to the axis and spaced from the axis. A plurality of cutters 50, 56, 58 are mounted on the open end 26 of the body 20 and directed at least partly axially away from the body 20. Accordingly, the auger is operable to cut an ice core 114 when the handle is in the first position and to carry articles 210 inside the body 20, 22, when the handle 70, 170 is in the second position.

The handle 70, 170 is preferably pivotable on the closed end 24 of the body 20 between the first position and the second position. Means 44, 76 are provided for locking the handle 70, 170 in at least one of the first and second positions. The body preferably includes a flange 40 protruding from the closed end 24 and the handle 70, 170 has a strap 72 engagable with the flange 40 in either of two opposite orientations (FIGS. 1, 2 and 13), the strap 72 being substantially perpendicular to the axis. The flange 40 has a pivot hole 42 and a locking hole 44 for fixing the handle 70, 170 to the body 20 via the strap 72, the strap likewise having a pivot hole, as well as two locking holes spaced from the pivot hole by a distance equal to a spacing of the holes 42, 44 in the flange 40, the strap 74 and the flange 40 being attachable by fasteners 74, 76 through the holes 42, 44. A permanently mounted pin 74 can pass through the pivot hole 42 and the strap 72, and a removable locking pin 76 can lock the handle 70, 170 to the flange 40 through either of the two locking holes of the strap.

A cover 90 fits over the open end 26 of the body 20 and over the cutters 50, thereby closing a volume defined within the body 20, 22. At least one tether 78, 92 attaches together at least two of the handle, the cover, the removable locking pin and the body.

The body 20 preferably includes a plurality of radially protruding fins 28 wrapped helically around an outside surface of the body, and proceeding away from the cutters 50. The cutters 50 include inclined blades 56, 58 disposed on front edges 54 of mounting shoes 52, the mounting shoes being attachable to the open end 26 of the body 20 at a terminus 36 of at least one of the fins 28. The fins 28 are preferably widened adjacent the terminus 36 and the shoes 52 define annular sections of semicircular arcs extending around the body 20 through substantially equal angles with the widened fins 28, 36, the shoes 52 having a radial width substantially equal to a thickness of the tubular body 22 and one of the fins 28. The shoes 52 are attached to the body 20, 36 by fasteners 62 extending into the widened fins 36, 28. Preferably, the three fins 28 are provided, each of the fins having the widened terminus carrying a shoe.

Preferably, the body has three said fins 28, each of the fins 28 having the widened terminus 36 carrying a shoe 52 and a cutter 56, 58, located about 120 degrees from each other around the open end 26 of the body 20. Each cutter 50 preferably has an inclined blade 56, 58 attached to the leading edge 54 of the shoe 52. The blade may be a disc-shaped blade 56, attachable by fastener 60 to the shoe 52, terminus 36 and body 20. The cutter blades 56 may be truncated conical discs, each attached by its smaller diameter side to the inclined leading face 54 of an associated shoe 52, a cutter edge 68 of the cutter 56 being defined by an outer edge of a larger diameter side 66 of the disc 56, the cutter edge protruding axially from the shoe 52 at the opening end 26 of the body 20.

The cutter may have an inclined, spade-shaped blade 58 attached to a shoe 52, with flat faceted faces tapering to a point, the blade 58 being a rectilinear body attached by a side including the faceted faces to the incline leading face 54 of the associated shoe 52, an opposite flat face 66 leading in a cutting direction, a cutting edge 68 of the cutter 58 being defined between the flat face 66 on one side of the rectilinear body 58 and a face on an opposite side of the rectilinear body. The point to which the faceted faces taper can be off center relative to a center line of the blade. The cutter is preferably arranged with the shoe 52 to define a cutting angle about 1 degree and about 10 degrees relative to a base line of the shoe 52.

What is claimed is:

1. An ice auger comprising:

a hollow tubular body defining an axis, the body being open on one end and substantially closed on an opposite end, the body including a flange protruding from the closed end;

a handle having a shaft part and a grip part, the handle being attachable to the body at a first position relative to the body, in said first position the handle extending generally along the axis away from the body, and one of the shaft part and the grip part being eccentric to the axis, the handle having a strap engageable with the flange on said body in either of two opposite orientations, the strap being substantially perpendicular to the axis, whereby the handle is operable manually to turn the body around the axis; and, means on said body for attaching the handle at a second position, wherein the handle is disposed along an outside surface of the body generally parallel to the axis and spaced from the axis, said handle being pivotable on the closed end of the body between said first position and said second position;

means for locking the handle in at least one of said first and second positions;

a plurality of cutters mounted on the open end of the body and directed at least partly axially away from the body;

whereby the auger is operable to cut an ice core when the handle is in the first position and to carry articles inside the body when the handle is in the second position.

2. The ice auger of claim 1, wherein the flange has a pivot hole and a locking hole for fixing the handle to the body via the strap, the strap having a pivot hole and two locking holes spaced from the pivot hole by a distance equal to a spacing of the holes in the flange, the strap and the flange being attachable by fasteners through the holes.

3. The ice auger of claim 2, further comprising a permanently mounted pin passing through the pivot hole and the strap, and a removable locking pin for locking the handle to the flange through either of the two locking holes of the strap.

4. An ice auger comprising:

a hollow tubular body defining an axis, the body being open on one end and substantially closed on an opposite end, a handle having a shaft part and a grip part, the handle being attachable to the body at a first position relative to the body, in said first position the handle extending generally along the axis away from the body, and one of the shaft part and the grip part being eccentric to the axis, whereby the handle is operable manually to turn the body around the axis; and, means on said body for attaching the handle at a second position, wherein the handle is disposed along an outside surface of the body generally parallel to the axis and spaced from the axis;

a plurality of cutters mounted on the open end of the body and directed at least partly axially away from the body;

a cover dimensioned to fit over the open end of the body and over the cutters, thereby closing a volume defined within the body; and, a removable locking pin for fixing the handle relative to the body and at least one tether attaching together at least two of the handle, the cover, the removable locking pin and the body, whereby the auger is operable to cut an ice core when the handle is in the first position and to carry articles inside the body when the handle is in the second position.

* * * * *